United States Patent [19]

Baranyi

[11] 4,406,756

[45] Sep. 27, 1983

[54] HARD CHROMIUM PLATING FROM HEXAVALENT PLATING BATH

[75] Inventor: Anthony D. Baranyi, Mississauga, Canada

[73] Assignee: Canadian Corporate Management Company Limited, Mississauga, Canada

[21] Appl. No.: 282,522

[22] Filed: Jul. 13, 1981

[51] Int. Cl.[3] ..... C25D 3/10

[52] U.S. Cl. ..... 204/51

[58] Field of Search ..... 204/51, 43 R, 105 R, 204/123

[56] References Cited

U.S. PATENT DOCUMENTS

| | | | |
|---|---|---|---|
| 1,496,845 | 6/1924 | Grube | 204/51 |
| 1,542,549 | 6/1925 | Grah | 204/51 |
| 1,590,170 | 6/1926 | Hosdowich | 204/51 |
| 1,600,076 | 9/1926 | Suzuki | 204/51 |
| 1,730,349 | 10/1929 | Auerbach | 204/51 |
| 1,749,443 | 3/1930 | Proctor | 204/51 |
| 1,802,463 | 4/1931 | Fink | 204/51 X |
| 2,801,214 | 7/1957 | Zell | 204/51 |
| 3,232,854 | 2/1966 | MacLean et al. | 204/51 |
| 3,706,642 | 12/1972 | Brannan | 204/51 |
| 3,772,170 | 11/1973 | Bharucha | 204/51 |
| 3,833,485 | 9/1974 | Crowther et al. | 204/43 R |
| 4,142,948 | 3/1979 | Tajima | 204/43 R |

FOREIGN PATENT DOCUMENTS

| | | | |
|---|---|---|---|
| 54-71048 | 7/1979 | Japan | 204/51 |
| 231993 | 11/1968 | U.S.S.R. | 204/43 R |

OTHER PUBLICATIONS

"From a Murky Chromium Plating Bath, Some Bright New Answers" General Motors Research Laboratories, J. Electrochem. Soc. Feb., 1979, p. 160, 190–198.

"Additives in Hard Chromium Plating Baths" Doskor, J. et al., Metal Finishing, Mar. 1967, pp. 71 to 79.

*Primary Examiner*—G. L. Kaplan

*Attorney, Agent, or Firm*—Ridout & Maybee

[57] ABSTRACT

The efficiency of hard chromium plating from a standard aqueous acidic bath containing hexavalent chromium ions and sulfate ions is increased by the addition of lower alkyl amino acids, di(lower alkyl)formamides, di(lower alkyl)sulfoxides and bisulfate salts.

25 Claims, No Drawings

HARD CHROMIUM PLATING FROM HEXAVALENT PLATING BATH

The present invention relates to a process for hard chromium plating from a bath containing hexavalent chromium (VI). More particularly, the invention relates to processes and electroplating baths using certain additives whereby the efficiency of the plating process can be improved.

Hard chromium plating, with which the invention is concerned, is to be distinguished from decorative chromium plating in which latter process deposits of chromium usually of the order of 0.00002 mm thickness are formed merely to provide an attractive bright finish on the article which is to be plated. In contrast, with hard chromium plating the thickness of the plating is usually in the range 0.001 mm to 0.5 mm. Further, the hard chromium plating process is usually carried out at higher bath concentrations of electrolytes, at higher temperatures, and at different plating rates, as compared with the decorative plating process.

In typical applications, deposits of hard chromium are employed to form a hard, abrasion-resistant and chemically passive surface, which is also noted for its "anti-seize" properties. Examples of articles on which the hard chromium deposits are customarily applied include internal combustion engine cylinders, crankshafts for marine and aero engines, bearings, hydraulic rams, gudgeon pins, gears, and all types of printing plates and cylinders.

As noted above, in hard chromium plating relatively thick deposits of the metal need to be formed and considerable quantities of electric current need to be passed for prolonged periods in order to obtain the required thickness of plating. In view of rising energy costs it is of increasing importance that the efficiency of the process should be as high as possible. By "efficiency" is means the actual weight of chromium plated out expressed as a percentage based on the theoretical electrochemical equivalent weight of chromium that should be deposited by the quantity of electrical charge passed through the bath during the period of plating. With the conventional bath, these efficiencies are no more than about 5 to 10%.

The present inventor has found that certain novel additives can approximately at least double the efficiency of the bath as compared with the conventional hard chromium hexavalent plating bath.

The present invention provides a chromium plating bath comprising an electrically-conductive aqueous solution of hexavalent (VI) chromium, the bath being electrolytically decomposable on passage of an electric current therethrough to plate out a hard metallic chromium deposit at the cathode, said bath also having dissolved therein a minor effective amount of a bath efficiency-improving additive selected from the group consisting of: lower alkyl amino acids; di(lower alkyl)formamides; bisulfate salts; di(lower alkyl)sulfoxides; and mixtures thereof, wherein the lower alkyl groups contain from 1 to 3 carbons.

The invention also provides a hard chromium plating process comprising the steps of: providing a plating bath comprising an aqueous solution of electrically conductive hexavalent chromium ion and of an effective amount of a bath efficiency-improving additive selected from the group consisting of: lower alkyl amino acids; di(lower alkyl)formamides; di(lower alkyl)sulfoxides, wherein the lower alkyl groups contain 1 to 3 carbons; bisulfate salts; and mixtures thereof; maintaining said bath at a temperature of from about 30° to 60° C.; applying an electroplating current across the bath between a hard chromium deposit-receptive cathode and an anode immersed in the bath; and continuing said electroplating for a period of time sufficient to plate out on the cathode a smooth hard adherent chromium plate layer of from about 0.001 to about 0.5 mm thickness, the actual weight of chromium deposited on said cathode being in the range of from about 14 to about 35% of the theoretical electrochemical equivalent weight of chromium depositable by the quantity of electrical charge passed during the period of plating.

The said efficiency-improving additives can be employed in conventional hexavalent chromium plating baths formulated to be decomposable to yield hard chromium deposits, without requiring any adaptation or further modification of the compositions of the baths, and the baths thus obtained may be used under conventional regimes of current density, temperature, nature of the electrodes, etc. to yield hard chromium deposits having good mechanical and metallurgical properties as compared with deposits obtained from baths from which the said additives are absent, and, moreover, there is a much smaller expenditure of electrical energy required to yield the required hard deposit.

It has been found that the said additives can provide improved efficiencies of up to about 23% in the case of the aminoacids, up to about 28% in the case of the di(lower alkyl)formamides, up to about 35% in the case of the bisulfate salts and up to about 28% in the case of the di(lower alkyl)sulfoxides, whereas as noted above in the absence of these additives the efficiency is in the range of about 5 to 10%.

Further it has been found that the chromium plate obtained from baths containing the above-mentioned additives are harder, have a better surface finish and show excellent adhesion, as compared with baths from which these additives are absent.

As noted above, the additives may be employed in otherwise conventional chromium VI hard plating baths and processes. For the avoidance of doubt, some description of the baths and processes will be given.

The hexavalent chromium ion can be and preferably is added to the bath in the form of pure chromic acid ($CrO_3$). It will be appreciated that there may be employed as the source of chromium VI ion, instead of or in addition to the chromic acid, such other sources of hexavalent chromium ion as will provide an aqueous hexavalent chromium solution decomposable electrolytically to yield a hard chromium electrodeposit. The concentration of chromium (VI) ion in the bath is preferably at least about 100 g/l (calculated as $CrO_3$), since at concentrations much below this level the rate of deposition of the chromium becomes unacceptably slow and the periods of time required for deposition of the relatively thick chromium layers become impracticably long. More preferably, the concentration of chromium VI ion is at least about 150 g/l (calculated as $CrO_3$) and concentrations of about 200 g/l or above are more usual. The maximum content of chromium VI in the bath is determined by the limit of solubility of the chromium compound employed, but in order to avoid excessive wastage of the chromium compounds the bath will usually contain up to about 400 g/l of the hexavalent ion (calculated as $CrO_3$).

The electroplating process is preferably carried out at current densities of about 0.1 to 0.7 A/cm$^2$ at the cathode. At lower current densities there is the disadvantage that the process has low throwing power, and the adhesion and density of the deposit tend to be poor and the deposit tends to have a grainier surface finish and to have a coarser crystalline structure. The higher the current density, the greater the risk of "burning" of the deposit i.e. the deposit tends to be non-uniform, and has a beaded surface and poor adhesion. More preferably the current density at the cathode is about 0.3 to 0.45 A/cm$^2$.

The hard chromium plating baths with which the invention is concerned are formulated to have an acid pH and contain a catalyst which facilitates the deposit of a chromium layer of the required quality. The catalyst is sulfate ion, usually added in the form of sulfuric acid, although the sulfate ion may also be added in the form of chromium sulfate, sodium sulfate or chromium carbonate containing sulfate ion as an impurity. Usually, the ratio weight of hexavalent chromium (calculated as $CrO_3$) to sulfate ion (calculated as $H_2SO_4$) will be in the range 50:1 to 200:1. When the bath contains the most preferred concentrations of hexavalent chromium this ratio will typically be about 150:1. The baths containing the additives may be employed at temperatures in the normal working ranges conventionally employed for hard chromium plating, preferably in the range of about 30° to 60° C., more preferably about 30° to 55° C. At lower temperatures the deposit obtained tends to be rough and dark, with a granular suface. Temperatures higher than about 60° C. are usually avoided in view of the increased energy costs of heating the bath and also the rate of evaporation of water from the bath increases with increasing temperatures, which may lead to undesirable increases in the concentration of the dissolved materials.

Preferably the anodes employed in the plating bath are inert with respect to the contents of the bath and to the reactions taking place at the anode. The usual inert lead anodes or stainless steel anodes may be employed. Carbon anodes may also be employed but these are subject to electrolytic corrosion due to the oxidation reaction occurring at the anode and need to be replaced at frequent intervals and are for that reason not preferred. The workpiece or cathode on which the hard chromium deposit is to be formed may be formed of any of the usual materials on which such deposits are made. Typically, the cathode will be steel but it will be appreciated that the process may be employed for all other substrates to which hard chromium deposits may be applied. The cathode may be subjected to the usual pretreatments intended to improve the adhesion and quality of the deposit. For example the cathode may be subjected to cleaning, degreasing, buffing or polishing operations, and to a reverse etching process which renders the subsequent chromium deposit strongly adhering, in which the workpiece is made the anode in a bath which may be of the same composition as the plating bath, or may be an aqueous solution of chromic acid ($CrO_3$), the reverse etching being carried out at current densities generally the same as those employed in the subsequent plating operation, for periods of typically 30 seconds to 5 minutes.

In the plating operation, the process is continued until the required thickness of hard chromium deposit has been built up on the workpiece. Typically, a thickness of deposit in the range 0.001 mm to 0.5 mm will be required.

The said amino acid additives may be represented by the formula $R(NH_2)COOH$, wherein R is a $C_1$ to $C_3$ alkylene group. Examples include glycine, wherein R is methylene ($CH_2$) group, and its homologues namely $\alpha$- and $\beta$- aminopropionic acid and the corresponding straight chain and branched chain amino-substituted butyric acid compounds, i.e. $\alpha$-, $\beta$-, and $\gamma$- aminobutyric acid, and 3-amino, 2-methylpropanoic acid and 2-amino, 2-methylpropanoic acid. In these latter compounds R represents straight and branched chain ethylene and propylene radicals. Of these, glycine is preferred by reason of its ready availability and smaller cost.

With all of the additives which are the subject of the present invention, an increase in the plating efficiency is achieved with the addition of a relatively low concentration of the additive to the plating bath. With increasing small additions of the additive, the efficiency is found to increase up to a certain level and then begins to decrease with increasing additions.

Thus, beyond a certain optimum concentration, there is little or no advantage in adding further quantities of the additive to the bath. For this reason, in the case of the lower alkyl aminoacids, di(lower alkyl) formamides, and di(lower alkyl) sulfoxides it is preferred to add no more of the additive than is necessary to achieve a concentration of about 15 g/l in the bath, and in the case of bisulfate salts no more than about 0.15 mole/l (calculated as bisulfate ion), as above these levels the improvements in efficiency that are obtained are not as great as they are at lesser concentrations, and there is merely increased consumption of the additive.

In the case of the baths containing the lower alkyl amino acids, the best improvements in efficiency are obtained using the additive at a concentration of about 0.1 to 5 g/l, more preferably about 0.625 to 2.5 g/l. For example, employing a standard bath composition comprising an aqueous solution of chromic acid ($CrO_3$) in an amount of 2.00 g/l and sulphuric acid as a conventional catalyst in an amount of 1.33 g/l, and with varying quantities of glycine as efficiency-improving additive, efficiencies of from about 20% to about 23.5% are obtained using additive concentrations of glycine of about 0.625 to 2.5 g/l.

The said di(lower alkyl) formamides may be represented by the formula $HCONHR_1R_2$ wherein $R_1$ and $R_2$ are the same or different and each represents a $C_1$ and $C_3$ straight or branched chain alkyl group. Examples of dialkyl-substituted formamides which may be employed as additives in the bath include dimethylformamide, diethlyformamide dipropylformamide, and formamides having mixed alkyl group substituents e.g. methylethylformamide, ethylpyopylformamide, etc. The preferred compound is dimethylformamide because of its ready availability. As noted above, good improvements in efficiency are obtained with concentrations of the formamide ranging up to about 15 g/l, preferably up to about 2.5 g/l, more preferably about 1 to 2.4 g/l.

Efficiencies of from about 17 to 28% are obtainable depending on the composition of the bath. For example with an addition of 1.18 g/l dimethylformamide an efficiency of about 27% is obtainable in the standard bath composition identified above.

The di-loweralkyl sulfoxides may be represented by the formula $R_1R_2SO$ wherein $R_1$ and $R_2$ are as defined above. Examples include dimethylsulfoxide, which is preferred because of its wide availability and relatively low cost, diethylsulfoxide, dipropylsulfoxide, and mixed lower alkylsulfoxides e.g. methylethylsulfoxide etc. The preferred range of addition to the bath is up to about 15 g/l, more preferably about 0.3 to 14 g/l. Within the latter range of addition, bath efficiencies of from about 14 to 28% are obtainable. As noted above, somewhat lower efficiencies are obtained with contents of sulfoxide outside this range. By way of example, it may be mentioned that in the standard bath composition identified above an efficiency of about 18% is achievable using a concentration of about 6.5 g/l dimethylsulfoxide as efficiency improving additive.

When bisulfate is employed as additive it is preferably added to the bath in the form of a salt of which the cation is compatible with and does interfere with the electrochemical reactions taking place within the bath and so does not impair the quality of the chromium deposit. Suitable examples include ammonium bisulfate and alkali metal bisulfates and of these sodium bisulfate is generally preferred as being readily available and of low cost. As mentioned above, the bisulfate salt is advantageously preferably added in a quantity sufficient to yield a concentration of $HSO_4$ ion of up to about 0.15 mole/l of the bath, more preferably up to about 0.05 mole/l. Particularly good bath efficiencies, in the range of about 15 to 35% are obtained with concentrations of bisulfate ion due to the additive in the range of about 0.002 to about 0.03 mole/l.

The above-mentioned additives are compatible with one another and so may also be employed in admixture with one another if desired.

Thus, for example, excellent bath efficiencies may be obtained employing a combination of lower alkyl amino acid e.g. glycine and bisulfate, the concentration of glycine or other aminoacid preferably being in the range about 0.1 to 5 g/l, more preferably about 0.625 to 2.5 g/l and the concentration of bisulfate, added for example as $NaHSO_4$, preferably being in the range 0.002 to 0.03 mole/l, more preferably about 0.01 to 0.02 mole.l (bisulfate ion), or a combination of bisulfate and di(lower alkyl)sulfoxide, with the concentration of bisulfate preferbly yielding bisulfate ion in the range about 0.002 to 0.03 mole/l, more preferably about 0.01 to 0.02 mole/l, and the concentration of sulfoxide e.g. dimethylsulfoxide preferably being in the range about 0.3 to 15 g/l, more preferably about 0.3 to 14 g/l.

The said additives are also compatible with various known additives which serve to beneficiate the quality of the deposit or increase the efficiency of the process, and may therefore be employed in admixture with such known additives, which may be added singly or in combination, such as, for example trivalent chromiumsulfate $Cr_2(SO_4)_3 \cdot 15H_2O$, preferably added in a concentration of about 3 g/l, oxalic acid, preferably added in an amount of up to about 6.5 g/l, sucrose, preferably added in an amount up to about 1 g/l, ferrous sulfate $FeSO_4 \cdot 7H_2O$ added in an amount of preferably up to about 0.5 g/l and trimethylammonium chloride, preferably added in an amount up to about 6.5 g/l.

Some examples of baths formulated at acid pH and containing sulfate ion as catalyst, and plating processes employing the novel additives will now be given.

EXAMPLE I

A bath was prepared by dissolving in water $CrO_3$ at 200 g/l and $H_2SO_4$ at 1.33 g/l. The weight ratio $CrO_3$:$H_2SO_4$ was 150:1. Dimethylsulfoxide was added as an efficiency improving additive in an amount of 6.49 g/l. The bath was maintained at 50° C. and plating was conducted using conventional lead anodes and a steel cathode at a current density of 0.31 A/cm$^2$ for 10 hours. An excellent hard chromium deposit was obtained which was smooth and strongly adherent, and the current efficiency was 18.18%.

EXAMPLE II

A bath was prepared by dissolving in water 200 g/l $CrO_3$, 2 g/l $H_2SO_4$ and 1.9 g/l $NaHSO_4$ as efficiency improving additive. The $CrO_3$:$H_2SO_4$ weight ratio was 100:1. Plating was carried out using a cathode and anode similar to Example I at a bath temperature of 55° C. and a current density of 0.39 A/cm$^2$ for 1½ hours. A hard chromium deposit of excellent properties was obtained and the current efficiency was 14.98%.

EXAMPLE III

Example 1 was repeated except the additive was glycine at 2.5 g/l and the bath temperature was 40° C. The period of plating was 2 hours. An excellent hard chromium deposit was obtained. The current efficiency was 21.45%.

EXAMPLE IV

Example III was repreated except the additive was 1.18 g/l dimethylformamide and the period of plating was 1⅔ hours. An excellent hard chromium deposit was obtained. The current efficiency was 26.81%.

EXAMPLE V

Example I was repeated except the additive was a mixture of sodium bisulfate, 0.94 g/l, and dimethylsulfoxide 2 g/l. The bath temperature was 45° C. An excellent hard chromium deposit was obtained, and the current efficiency was 19.29%.

I claim:

1. A chromium plating bath comprising an electrically-conductive acidic aqueous solution containing dissolved therein hexavalent (VI) chromium and a source of sulfate ion in a weight ratio of hexavalent chromium (calculated as $CrO_3$) to sulfate ion (calculated as $H_2SO_4$) of from about 50:1 to about 200:1, the bath being electrolytically decomposable on passage of an electric current therethrough to plate out a hard metallic chromium deposit at the cathode, said bath being a substantially wholly aqueous solution and being substantially free of metal so-depositable with chromium and having dissolved therein a minor effective amount of up to about 15 g/l of an organic bath efficiency-improving additive selected from the group consisting of: lower alkyl aminoacids; di(lower alkyl)formamides; di(lower alkyl)sulfoxides; and mixtures thereof, wherein the lower alkyl groups contain from 1 to 3 carbons.

2. A bath as claimed in claim 1 wherein said additive is glycine of formula $CH_2NH_2COOH$ in an amount of about 0.1 to 5 g/l.

3. A bath as claimed in claim 2 wherein said amount is about 0.625 to 2.5 g/l.

4. A bath as claimed in claim 1 wherein said additive is dimethylformamide in an amount of up to about 2.5 g/l.

5. A bath as claimed in claim 4 wherein said amount is about 1 to 2.4 g/l.

6. A bath as claimed in claim 1 wherein said additive is dimethylsulfoxide in an amount of up to about 15 g/l.

7. A bath as claimed in claim 6 wherein said amount is about 0.3 to 14 g/l.

8. A bath as claimed in claim 1, 2, 4, or 6 wherein said weight ratio is about 150:1.

9. A bath as claimed in claim 1 containing a further deposit-beneficiating additive selected from the group consisting of trivalent chromium sulfate, oxalic acid, sucrose, ferrous sulfate, trimethylammonium chloride, and mixtures thereof.

10. A bath as claimed in claim 1 wherein the concentration of hexavalent chromium ion in the bath is about 100 to 400 g/l (calculated as $CrO_3$).

11. A bath as claimed in claim 10 wherein said concentration is about 150 to 400 g/l.

12. A hard chromium plating process comprising the steps of: providing a plating bath comprising an electrically conductive acidic aqueous solution containing hexavalent chromium ion, a source of sulfate ion in a weight ratio of hexavalent chromium (calculated as $CrO_3$) to sulfate ion (calculated as $H_2SO_4$) of from about 50:1 to about 200:1, and an effective amount of up to about 15 g/l of an organic bath efficiency-improving additive selected from the group consisting of: lower alkyl amino acids; di(lower alkyl) formamides; di(lower alkyl)sulfoxides, wherein the lower alkyl groups contain 1 to 3 carbons; and mixtures thereof; said bath being a substantially wholly aqueous solution and being substantially free of metal co-depositable with chromium; maintaining said bath at a temperature of from about 30° to 60° C; applying an electroplating current across the bath between a hard chromium deposit-receptive cathode and an anode immersed in the bath; and continuing said electroplating for a period of time sufficient to plate out on the cathode a smooth hard adherent chromium plate layer of from about 0.001 to about 0.5 mm thickness, the actual weight of chromium deposited on said cathode being in the range of from about 14 to about 35% of the theoretical electrochemical equivalent weight of chromium depositable by the quantity of electrical charge passed during the period of plating.

13. A process as claimed in claim 12 wherein the electroplating current density is about 0.1 to 0.7 $A/cm^2$ at the cathode.

14. A process as claimed in claim 13 wherein said current density is about 0.3 to 0.45 $A/cm^2$.

15. A process as claimed in claim 12 wherein the bath is maintained at a temperature of from about 30° to 55° C.

16. A process as claimed in claim 12 wherein said additive is glycine of formula $CH_2NH_2COOH$ in an amount of about 0.1 to 5 g/l.

17. A process as claimed in claim 16 wherein said amount is about 0.625 to 2.5 g/l.

18. A process as claimed in claim 12 wherein said additive is dimethylformamide in an amount of up to about 2.5 g/l.

19. A process as claimed in claim 18 wherein said amount is about 1 to 2.4 g/l.

20. A process as claimed in claim 12 wherein said additive is dimethylsulfoxide in an amount of up to about 15 g/l.

21. A process as claimed in claim 20 wherein said amount is about 0.3 to 14 g/l.

22. A process as claimed in claim 12 wherein the bath contains a further deposit-beneficiating additive selected from the group consisting of trivalent chromium sulfate, oxalic acid, sucrose, ferrous sulfate, trimethylammonium chloride, and mixtures thereof.

23. A process as claimed in claim 12 wherein said weight ratio of chromium to sulfate ion is about 150:1.

24. A process as claimed in claim 12 wherein the concentration of hexavalent chromium ion in the bath is about 100 to 400 g/l (calculated as $CrO_3$).

25. A process as claimed in claim 24 wherein said concentration is about 150 to 400 g/l.

* * * * *